United States Patent [19]

Hodge

[11] Patent Number: 4,984,740

[45] Date of Patent: Jan. 15, 1991

[54] WATER SPRINKLER WITH VARIABLE STREAM-DISTANCE ADJUSTMENT

[76] Inventor: Robert B. Hodge, 430 Driftwood St., Morro Bay, Calif. 93442

[21] Appl. No.: 367,872

[22] Filed: Jun. 19, 1989

[51] Int. Cl.[5] ..... B05B 3/04

[52] U.S. Cl. ..... 239/232; 239/236; 239/513; 239/DIG. 1

[58] Field of Search ..... 239/DIG. 1, 230, 231, 239/232, 236, 233, 511, 513

[56] References Cited

U.S. PATENT DOCUMENTS

| | | | |
|---|---|---|---|
| 1,593,918 | 7/1926 | Stanton | 239/232 |
| 3,528,093 | 9/1970 | Eerkens | 239/232 |
| 3,654,817 | 4/1972 | Kane | 239/DIG. 1 |
| 3,960,327 | 6/1976 | Olson | 239/236 |
| 4,277,029 | 7/1981 | Rabitsch | 239/DIG. 1 |
| 4,497,441 | 2/1985 | Chow | 239/230 |
| 4,501,391 | 2/1985 | Hunter | 239/97 |
| 4,538,762 | 9/1985 | Lemkin | 239/DIG. 1 |
| 4,540,125 | 9/1985 | Gorney et al. | 239/232 |
| 4,632,312 | 12/1986 | Premo et al. | 239/230 |
| 4,637,549 | 1/1987 | Schwartzman | 239/230 |
| 4,648,558 | 3/1987 | Rabitsch | 239/DIG. 1 |
| 4,739,934 | 4/1988 | Gewelber | 239/446 |

*Primary Examiner*—Andres Kashnikow

*Assistant Examiner*—Christopher G. Trainor

*Attorney, Agent, or Firm*—Milton S. Gerstein

[57] ABSTRACT

An improved water-sprinkler having a vertically-pivotal control flap that is adjustably positionable with respect to the outlet of the nozzle, which controls the distances the emerging water-stream will reach. The control flap has an inner bracket-end that is pivotally mounted to a pivot block at the lower end of the bracket end, the upper part of the bracket-end being pivotally connected to a distal end of a control arm that is horizontally-adjustable via a series of circularly-arranged, independently and horizontally-movable sliding reeds or blocks, the distance of these sliding blocks from their radial center determining the horizontal position of the other end of the control arm, and, therefore, the end of the control arm connected to the upper end of the flap, whereby the spacing of the flap from the nozzle-outlet may be cyclically changed according to a desired pattern determined by the relative radial positions of the plurality of sliding blocks. Any pattern of sliding-block orientations may be achieved so as to conform the water-sprinkling to a desired pattern, so that during any sector of rotation, the nozzle-stream will water a relatively distant portion of the lawn, and for another sector of rotation, water a relatively near portion of the lawn in order to avoid wetting a patio, or the like.

18 Claims, 2 Drawing Sheets

WATER SPRINKLER WITH VARIABLE STREAM-DISTANCE ADJUSTMENT

BACKGROUND OF THE INVENTION

The present invention is directed to a water sprinkler commonly used for watering lawns, such as that disclosed in U.S. Pat. No. 1,997,901—Englehart. The conventional water sprinkler has a main nozzle through which the stream of water exits, which nozzle is connected to a mounting arm that is rotatably mounted on a stem via a pivot post, so that the nozzle may be rotated a full 360 degrees to water a lawn. An oscillatory reaction lever arm is also used upon which the stream of water impinges as it exits from the nozzle, which reaction lever arm causes the slow incremental rotation of the mounting arm about the stationary stem via the energy stored in a spiral spring encircling the main pivot post, the stored energy along with the energy of the vacuum created during the return stroke of the oscillating lever arm with respect to the flowing water stream developing a torque great enough to overcome the friction between the mounting pivot post and stationary stem, whereby relative rotational movement between the pivot post and stem ensues, to bring about the rotational movement of the stem. It is also known in the prior art to provide a water-stream height-deflector to vary the range of the water-stream exiting from the nozzle so that different radial distances from the sprinkler may be watered during one complete cycle of operation. One such system is disclosed in U.S. Pat. No. 3,960,327—Olson. However these prior-art devices are difficult to reset to suit changing watering patterns, are relatively difficult to initially set up, cannot provide for a multitude of distance-changes during one complete cycle, and cannot provide the exactness often required for stream-distance settings, but must rely upon a repeated trial-and-error approach.

SUMMARY OF THE INVENTION

It is the primary objective of the present invention to provide a water-sprinkler which provides the capability of continually adjusting the water-stream distance-discharge from the nozzle thereof in a relatively facile and easy manner, and which allows for the quick and easy resetting of these distances for one complete cycle of nozzle rotation.

It is an objective of the present invention to provide such an improved water-sprinkler such that the water-stream distances may be varied during one complete nozzle-rotation cycle to a much greater amount than hitherto possible.

The improved water-sprinkler of the invention has a vertically-pivotal control flap that is adjustably positionable with respect to the outlet of the nozzle, which controls the distances the emerging water-stream will reach. The control flap has an inner bracket-end that is pivotally mounted to a pivot block at the lower end of the bracket end, the upper part of the bracket-end being pivotally connected to a distal end of a control arm that is horizontally-adjustable via a series of circularly-arranged, independently and horizontally-movable sliding reeds or blocks, the distance of these sliding blocks from their radial center determining the horizontal position of the other end of the control arm, and, therefore, the end of the control arm connected to the upper end of the flap, whereby the spacing of the flap from the nozzle-outlet may be cyclically changed according to a desired pattern determined by the relative radial positions of the plurality of sliding blocks. Any pattern of sliding-block orientations may be achieved so as to conform the water-sprinkling to a desired pattern, so that during any sector of rotation, the nozzle-stream will water a relatively distant portion of the lawn, and for another sector of rotation, water a relatively near portion of the lawn in order to avoid wetting a patio, or the like. The sliding blocks are easily moved inwardly or outwardly relative to each other, and are locked in their desired pattern only by means of a lock washer, thus ensuring easy resetting of the sliding blocks when required or desired. Each sliding block is provided with radially-inwardly tapering side surfaces such that each block is formed from an outer sector-portion of the circle in which the sliding blocks are arrayed, whereby the narrower radially-inner end portions of each sliding block may slide radially-outwardly between the two directly-adjacent blocks, the distances between two adjacent blocks increasing in the radially-outward direction. Each sliding block is substantially infinitely positionable relative to its two directly-adjacent sliding block for controlling the movement of the other end of the control arm. Each sliding block is provided with rounded radially-exterior corner-edges to allow for the camming thereby of the radially-inner other end of the control arm as it is moved therepast during the portion of the sprinkler-cycle in order to position such other end at the horizontal location determined by the sliding block, the radially-inner other end of the control arm being biased toward the sliding blocks via the impinging force of the water-spray on the control-flap.

BRIEF DESCRIPTION OF THE DRAWINGS

The invention will be more readily understood with reference to the accompanying drawings, wherein.

DETAILED DESCRIPTION OF THE INVENTION

Figures 1, 2:
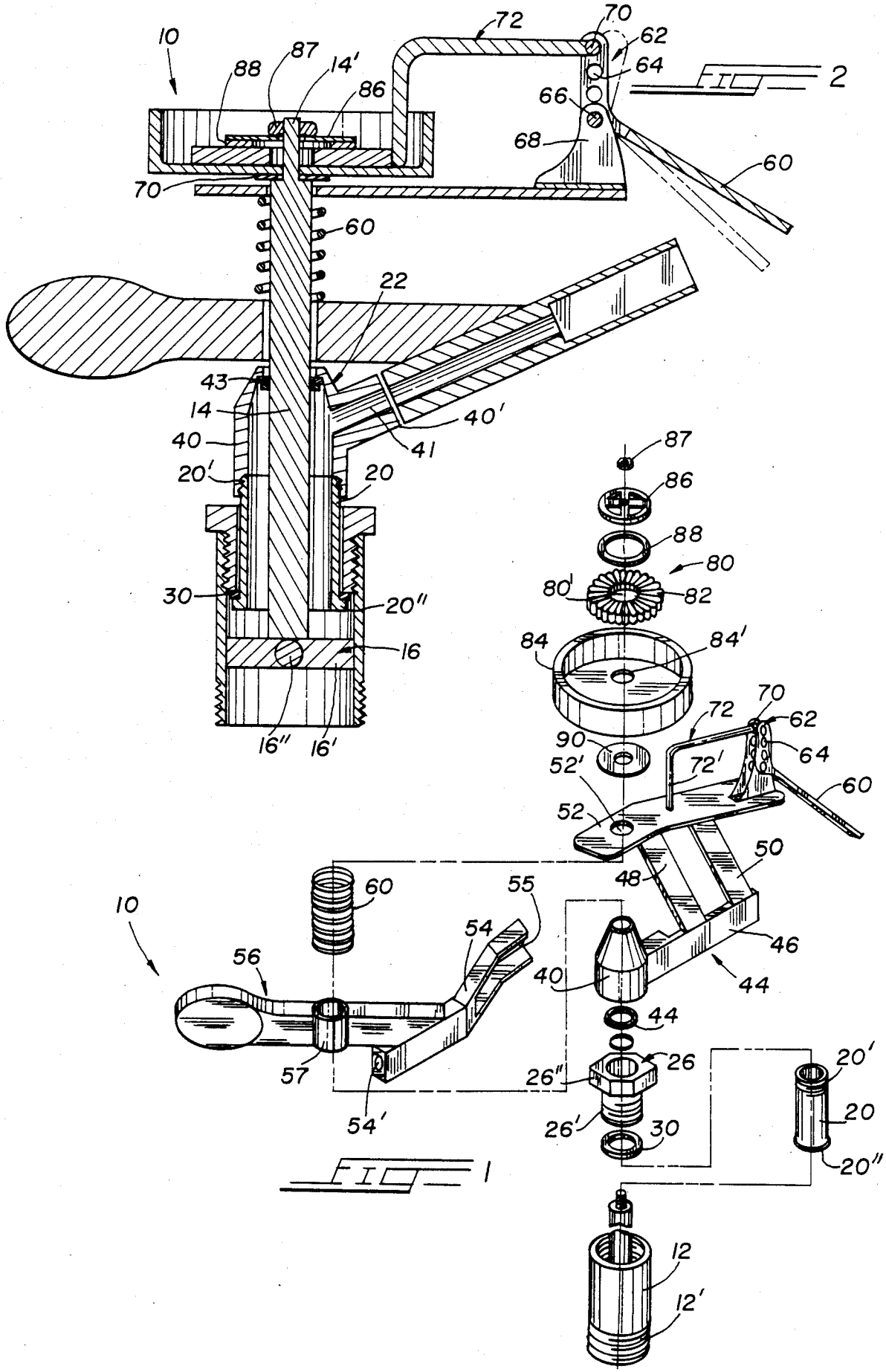
FIG. 1 is an assembly view, in perspective, of the water-sprinkler head of the invention showing the various parts and components thereof and their interconnection.
FIG. 2 is a side elevational view, in cross-section, showing the water-sprinkler head of the invention in its assembled state.
Figure 3:
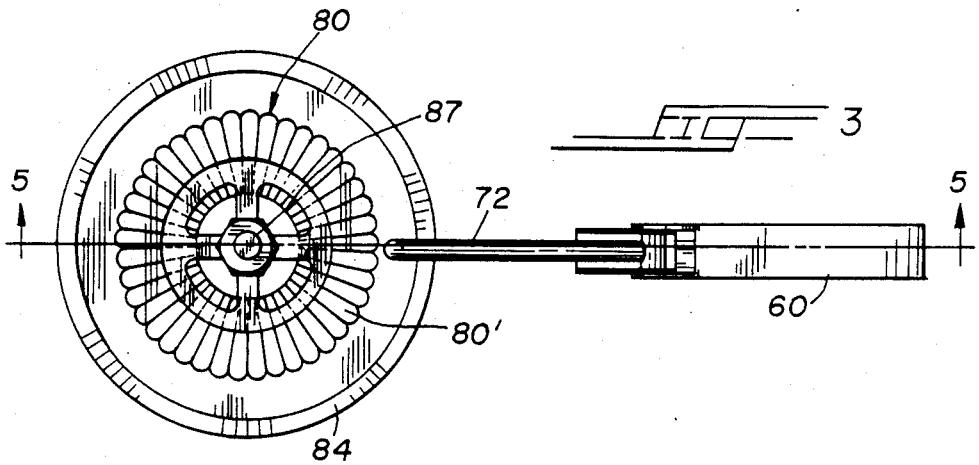
FIG. 3 is a top view thereof.
Figure 4:
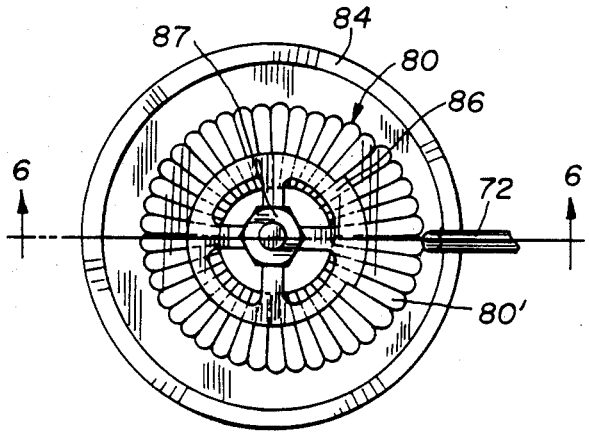
FIG. 4 is a top view similar to FIG. 3 but showing some of the slidable reeds or blocks moved outwardly for limiting the water-discharge distance of the sprinkler-head over a given range.
Figure 5:
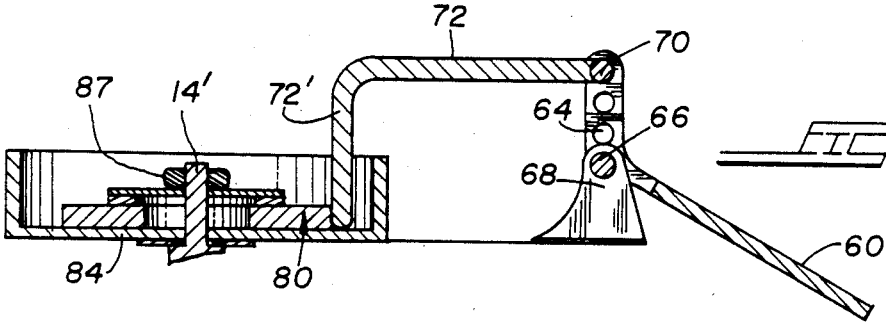
FIG. 5 is a cross-sectional view taken along line 5—5 of FIG. 3.
Figure 6:
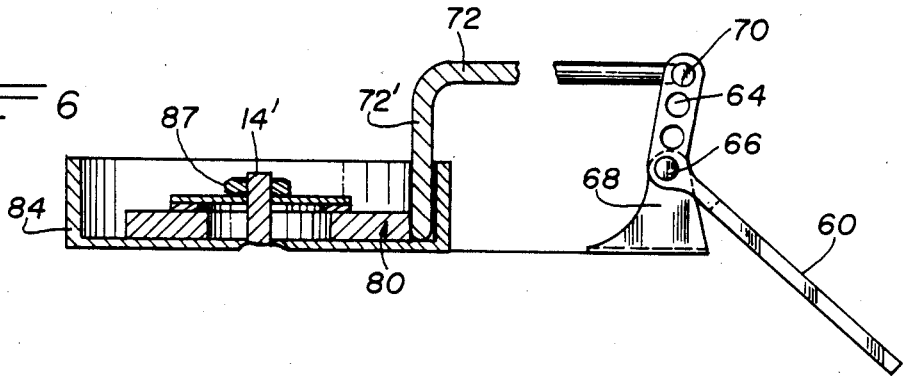
FIG. 6 is a cross-sectional view taken along line 6—6 of FIG. 4.

Referring now to the drawings in greater detail, the lawn-sprinkler head of the invention is indicated generally by reference numeral 10. The sprinkler 10 includes a lower, hollow mounting tube 12 which is affixed to a conventional mounting base (not shown), typically by screw threads 12', which base allows the sprinkler to be self-standing. The water for the sprinkler 10 enters through the bottom of the tube 12, as is conventional. Mounted within the hollow tube 12 is an upwardly-extending shaft 14 terminating in a upper screw shaft 14' for mounting the range-adjusting structure of the invention, described below. The shaft 14 is of much smaller diametric extent than the tube 12, and is fixedly secured to the mounting tube via a mounting disc 16 best seen in FIG. 2. The disc 16 is a cross-piece defining a pair of cross-members 16', 16" the ends of which are fixedly secured to the interior surface of the mounting tube 12, and preferably is formed integrally therewith by injection molding to produce one complete unit for strength and durability. Of course, other structure may be used to mount the lower end of the shaft 14 to the interior of the mounting tube 12, which will be obvious to one of ordinary skill in the art, as long as the flow of water entering the lower mouth of the mounting tube 12 may flow therepast. The disc 16 allows the water to flow therepast via the open area between cross-members. Telescopingly mounted within the upper open end or mouth of the mounting tube 12 is a hollow, rotatable support tube 20 having an upper, exterior-threaded circumferential end 20' for mounting a nozzle-sleeve 22, described below in greater detail. The support tube 20 projects partially into the hollow, upper interior of the mounting tube 12, and is secured from coming out of the mounting tube 12 via a relatively-short fastening screw-head 26 having a screw-shank 26' and larger head 26". The shank 26' is hollow to allow for the telescoping reception and projection therethrough of the upper part of the support tube 20 as seen in FIG. 2, and is mounted to the interior upper mouth of the mounting tube 12 via the interior circumferential mating threaded surfaced thereof. A lower circumferential flange or bead 20" of the support tube 20 abuts against the lower annular surface of the shank 26', with a washer or seal 30 acting as the intermediary therebetween, for providing a fluid-tight seal for the flowing water. When the upper, exteriorly-threaded end 20' of the support tube 20 is screwed onto the mating interiorly-threaded lower end of nozzle-sleeve 40 and water is streaming upwardly in the interior of the mounting tube 12, the rotatable support tube 20 is urged upwardly and the seal 30 into its sealing state, while still allowing the tube 20 to rotate freely. The nozzle-sleeve 40 is, of course, also hollow, and has a nozzle-end 40' with interior passageway 41 through which the water exits for providing a water-stream in the conventional manner. Additional seals 43 are also provided at the upper, exit mouth of the nozzle-sleeve through which passes the respective portion of the post or shaft 14. Integrally connected with the nozzle-sleeve 40 are conventional strike-plate portions, including longitudinal strike-plate 46, pair of platform support brackets 48, 50, and platform 52, this structure being conventional and well-known, such structure conventionally being struck by an oscillating striker-arm 54 of a striker-arm assembly 56, which is also conventional and well-known. The striker-arm assembly 56 and striker-plate assembly 44 rotate together as a unit, in the conventional manner, via the rotatable tube 20, such rotation being caused by pivoting of the arm 54 by the impinging water jet thereon, which water-jet exits through the passageway 41 and into the striker-arm 54 via the inlet opening 54' thereof, as is conventional. The water-jet then impinges upon a 45-degree angle surface 55 of the arm 54, which causes the pivoting of the striker-arm assembly 56 away from the striker-plate 46, or in the counterclockwise direction when viewing FIG. 1. This pivotal rotation of the striker-arm assembly is resisted by a torsion spring 60, the lower ends of which are secured to the assembly 56 in conventional manner, so that upon such pivotal rotation, the spring will thereafter force the reverse rotation of the striker-arm assembly which will then strike against the striker-plate 46, which will cause the incremental rotation of the striker-plate assembly 44. Such incremental movement is achieved owing to the partial vacuum created, as is well-known in prior art sprinkler-head systems, as set forth in U.S. Pat. No. 1,997,901. Thus, both assemblies 44 and 56 will incrementally revolve about in the clockwise direction when viewing FIG. 1, about the stationary post or shaft 14. Of course, the arm assembly 56 is provided with a conventional, hollow, pivot-sleeve 57 through which the post 14 passes after having passed through and exited the upper, open mouth of the nozzle-sleeve 40, whereby the oscillatory movement of the arm-assembly 56 is achieved, such pivot-sleeve 57 floating upon the upper end of the nozzle-sleeve 40 in conventional manner. The platform 52 of the invention mounts a pivotal lever arm 60 serving as a water-flap for controlling the range of the water-stream exiting from the striker-arm 54. The lever-arm 60 is formed with an integral, inner, bifurcated bracket-attachment 62 provided with a plurality of pairs of horizontally-aligned holes 64, each pair capable of passing therethrough a pivot shaft 66. The platform 52 mounts a bifurcated pivot-mounting block 68 defining a pair of upper horizontal-aligned holes through which is also passed the pivot shaft 66, thus rotatably mounting the lever-arm 60 for pivotal rotation in a vertical plane. The top pair of holes of the pair of holes 64 of the bifurcated bracket-attachment 62 receives a pivot shaft 70 at the distal end of an L-shaped control locator-arm or control adjusting arm 72. The arm 72 defines a vertical leg portion 72', with the arm 72 being freely pivotally mounted by the pivot shaft 70, so that the normal position of the arm 72 is with the lower end of the leg 72' resting upon the upper flat surface of the platform 52 via the center of gravity thereof causing a counterclockwise moment of the arm about the pivot shaft 70. It may be seen, therefore, that upon linear movement of the arm 72 along the length of the platform 52, the bifurcated bracket-attachment 62 is rotated in one direction or the other, to cause the drawing closer of the flap or lever arm 60 toward the water stream, or the moving away therefrom, whereby the distance such water stream reaches may be varied. According to the invention, the lever arm, water-flap 60 is set at various positions during the different portions of the revolution of the assemblies 44, 56, so that for certain arcuate portions of travel thereof, greater distances may be watered, and for other arcuate portions, shorter distances may be watered in order to avoid porches, decks, and the like. This achieved according to the invention by the provision of a stationary array 80 of slidable reeds or blocks 82. The array 80 is housed in an open shell or housing 84. The fixed post or shaft 14 mounts this housing 84 after passing through opening 52' formed in the inner end of the roof 52. The post 14 passes through a central opening 84' provided in the lower surface of the housing 84, so that the upper threaded end 14' of the post 14 projects therebeyond, which end passes through the central opening of the array 80, and is then passed through closure plate 86 and screwed to a locking nut 87 for securing the parts together. Washers 88, which may be made of neoprene, for example, 90 are also provided. The array 80 is arranged in circular fashion, with each reed 82 constituting a sector-portion of the circle, each reed having inwardly tapering side edge-surfaces and a curved outer end, the tapering side edge-surfaces accommodating the sliding movement of directly adjacent reeds, while the curve outer ends allowing for the vertical leg 72' to be cammed outwardly thereby, as explained below. The array 80 defines a central opening 80' through which passes the post 14. The individual reeds 82 are adjusted to a desired radial position by first loosening the nut 87, thereby releasing the plate 86 and washer 88 from contact against the upper surfaces of the reeds, to allow for the radial movement of the reeds. After the reeds have been set to the desired pattern, such as that shown in FIG. 4, the nut 87 is retightened. In the radially unextended, initial positions of the reeds 82, the leg portion 72' is spaced outwardly from the outer curved ends of the reeds, so that the control arm 72 is in its horizontal state shown in FIG. 1, and the water flap 60 in its uppermost state, allowing for a maximum spraying range. This state of the leg portion 72' is the rest or normal state thereof owing to the fact that the impinging water-stream on the water-flap urges the bracket-attachment 62 into its vertically-oriented, counterclockwise-rotated state where the lowest end of the leg portion 72' contacts the surface of the platform. When each reed is slid radially outwardly a desired distance, the leg portion 72' will then hit thereagainst during its movement therepast, causing the control arm 72 to move forwardly thereby pivoting the bifurcated bracket-attachment 62 in the clockwise direction, when viewing FIG. 1, to pivot the flap 60 downwardly, into a state where the water-stream range is reduced. Since each distal end of a reed is curved, the transition between differently-positioned reeds will occur easily by camming action. Any pattern of relative positions of reeds may be formed, with there preferably being a transition zone between different regions to allow for a gradual repositioning of the control lever 72 to avoid binding. It is clear that by causing the control lever 72 to move outwardly via the reeds, the lever arm 60 will be rotated about the pivot shaft 66 to achieve its new shorter-range position. It is, also, possible to connect the pivot shaft 70 to a lower pair of holes 64 to even further decrease the water-stream distance when the reeds 82 are slid to outer positions, the pivot shaft being easily removable from the pair of holes 64 for that reason.

While a specific embodiment of the invention has been shown and described, it is to be understood that numerous changes and modifications may be made therein without departing from the scope, spirit and intent of the invention as set forth in the appended claims. The present invention may also, of course, be used with conventional sprinkler heads that oscillate back and forth in both directions, rather than rotating in one direction only, the movable blocks of the invention and the mounting structure therefor being the same as that above-described.

What I claim is:

1. In a lawn-sprinkler comprising a sprinkler-head and a stationary frame, said sprinkler-head comprising means forming a water-passageway through which water flows, nozzle-means in fluid communication with said water-passageway and through which the water discharges, mounting means for mounting said means forming a water passageway and said nozzle-means for rotation relative to said stationary frame, and a water-flap mounted by said mounting means for rotation therewith, said water-flap being operatively associated with said nozzle means for controlling the distance to which the water-discharge stream projects from said nozzle means, the improvement comprising:

means for variably adjusting said water-flap relative to said nozzle-means during one complete cycle of said mounting means in order to vary the position of said water-flap at least one time during said one complete cycle;

said means for variably adjusting comprises means for pivotally mounting said water-flap to said nozzle means, and means for locating said water-flap in a desired pivoted location by pivoting said water-flap a desired amount about said means for pivotally mounting, said means for locating comprising a first portion in operative communication with said water-flap for causing the pivotal rotation thereof about said means for pivoting, and a second portion spaced from said first portion; and a plurality of horizontally, individually-slidable guide-elements stationarily mounted by said frame, said plurality of guide-elements being arranged in a circular array and being mounted above said mounting means for mounting said means forming a water passageway and said nozzle-means for rotation relative to said stationary frame, each said guide-element defining a radially-outer contact surface against which said second portion of said means for locating may abut for controlling the movement of said first portion for varying the pivoted-state of said water-flap, said second portion of said means for locating being movable in a horizontal direction by at least chosen ones of said radially-outward contact surfaces of said guide-elements.

2. The improvement according to claim 1, wherein said means for locating comprises a vertical leg portion defining said second portion, and a substantially longitudinally-extending horizontal leg portion defining said first portion; said water-flap comprising a bracket means for coupling said water-flap to said means for locating, said bracket means comprising a first lower end portion and a second upper end portion, said first lower end portion being connected to said means for pivotally mounting, and said second upper end portion being connected to said horizontal leg portion, said means for locating further comprising pivot-connection means for pivotally connecting said horizontal leg portion to said second portion.

3. The improvement according to claim 2, wherein each said guide-element comprises a pair of inwardly-sloping, radially-inwardly converging side surfaces, each said guide-element being sandwiched between two other said guide-elements, one on each lateral side thereof, each said side surface of said guide-element being in mutual contact with a said side surface of another, directly adjacent said guide-element.

4. The improvement according to claim 3, wherein each said guide-element defines a pair of arcuate transition regions, one said transition-region at the connection of one end of said contact surface with one said side surface, and a second said transition region at the connection of the other end of said contact surface with the other said side surface, whereby said transition regions act as camming members for positioning said means for locating.

5. The improvement according to claim 1, wherein said stationary frame comprises a hollow mounting tube through which the water initially flows, and upstanding means having a lower end connected to said mounting tube, and an upper end, and a housing for mounting said circular array of sliding guide-elements, said upper end of said upstanding means supporting said housing, said housing being stationarily mounted thereby.

6. The improvement according to claim 5, wherein said upstanding means comprises a vertically-oriented post, said post passing and said mounting means for mounting said means forming a water passageway said upper end of said post projecting outwardly beyond a portion of said nozzle means for coupling with said housing.

7. The improvement according to claim 6, wherein said circular array defines a central opening, said upper end of said post passing therethrough; said upstanding means further comprising means for retaining said circular array of guide-elements in said housing.

8. The improvement according to claim 7, wherein said housing comprises a support surface upon which rests said guide-elements, said upper end of said post passing through an opening of said support surface; said retaining means comprises a plate for contact against the upper surfaces of said guide-elements, and means for holding said plate against said upper surfaces.

9. The improvement according to claim 6, wherein said lower end is mounted within the hollow interior of said mounting tube; said mounting means comprising a rotatable hollow sleeve having an upper end portion and a lower end portion, said lower end portion being rotatably mounted in said hollow mounting tube, and means rotatably mounting said lower end portion of said sleeve in said mounting tube; said post passing through the hollow interior of said rotatable sleeve.

10. The improvement according to claim 6, wherein said lower end of said post is mounted within the hollow interior of said mounting tube; said upstanding means further comprising securing means for mounting said lower end of said post within the hollow interior of said mounting tube, said securing means defining open areas through which the charging water-stream may pass therepast during its passage through said hollow interior of said mounting tube.

11. The improvement according to claim 2, wherein said bracket means comprises a plurality of holes for vertically-adjustably mounting said water-flap to said means for pivotally mounting.

12. The improvement according to claim 11, wherein said first portion of said means for locating is adjustably positionable in said holes of said bracket means to adjust the initial maximum-discharge distance of said water-flap.

13. The improvement according to claim 12, wherein said bracket means is bifurcated, said plurality of pairs holes comprising a series of pairs of horizontally-aligned holes for said bifurcated bracket means, said pairs of holes being arranged in vertical alignment, one pair above the other, any lower said pair receiving said means for pivotally mounting, and any upper said pair receiving said pivot-connection means of said means for locating.

14. A water sprinkler comprising:

a mounting base;

a rotatable nozzle-arm for discharging water in a stream, said nozzle-arm having an inlet end and an outlet, discharge end;

means for mounting said nozzle-arm for rotation relative to said mounting base;

a vibratory nozzle-control arm operatively connected to said means for mounting said nozzle-arm for conjoint rotation therewith, said nozzle-control arm causing the incremental rotational advance of said nozzle-arm when a waterstream impinges thereon, said means for mounting said nozzle-arm comprising a strike-portion thereof against which said nozzle-control arm strikes for causing said incremental advance.

biassing means for urging said nozzle-control arm toward said strike-portion, the water-stream overcoming said biassing means when said nozzle-control arm is abutting contact against said strike-portion;

stationary mounting means mounted by said mounting base extending upwardly from said mounting base and passing through said means for mounting said nozzle-arm and defining an upper end portion above said nozzle-arm;

a water-flap nozzle-control pivotally mounted by said means for mounting said nozzle-arm for relative pivotal movement toward and away from said outlet of said nozzle-arm; said water-flap nozzle control rotating along with said nozzle-arm;

means for pivotally mounting said nozzle-control to said means for mounting said nozzle-arm;

means for adjustably positioning said water-flap nozzle-control to a desired pivoted position relative to said outlet of said nozzle-arm, said mean for adjustably positioning comprising means for selectively altering said pivoted position at least once during one complete rotation of said nozzle-arm and said means for mounting said nozzle-arm;

said means for adjustably altering being stationarily mounted by said upper end portion of said stationary mounting means;

said means for adjustably positioning comprising a plurality of camming members each being independently slidable with respect to the others; said camming members being arranged in a circular array; said nozzle-control comprising a rearwardly-extending cam-engaging element having a first rearward end portion that is capable of contact with said camming members, an intermediate portion having a lower end portion operatively coupled to said means for pivotally mounting said nozzle-control, and an upper end portion pivotally coupled to a forward portion of said cam-engaging element; said means for adjustably positioning further comprising a housing for housing said plurality of camming members for said slidable movement, said rearward end of said cam-engaging element being positioned in said housing for rotational movement and linear movement therein relative to said camming members, whereby by positioning the camming members in a desired pattern where some extend outwardly from others, said water-flap nozzle-control may be positioned into different pivotal states via said cam-engaging element.

15. The water sprinkler according to claim 14, wherein said means for adjustably positioning further comprises means for removably retaining in place said camming members in a desired said pattern, said means for retaining being released when said pattern is to be changed.

16. In a lawn-sprinkler comprising a sprinkler-head and a stationary frame, said sprinkler-head comprising means forming a water-passageway through which water flows, nozzle-means in fluid communication with said water-passageway and through which the water discharges, mounting means mounting said means forming a water passageway and said nozzle-means for rotation relative to said stationary frame, and a water-flap mounted by said mounting means for rotation therewith, said water-flap being operatively associated with said nozzle means for controlling the distance to which the water-discharge stream projects from said nozzle means, the improvement comprising:

means for variably adjusting said water-flap relative to said nozzle-means during one complete cycle of said means mounting for rotation in order to vary the position of said water-flap at least one time during said one complete cycle; and said means for variably adjusting comprising a plurality of individually-slidable members each defining an outer camming surface; follower means comprising a first portion capable of abutting contact with each said camming surface, and a second portion; pivot means for mounting said water-flap for rotational movement, said pivot means being coupled to said second portion of said follower means; said second portion of said follower means comprising means for magnifying the pivotal movement of said water-flap for the same movement of said first portion of said follower means.

17. The improvement according to claim 16, wherein said second portion comprises a bracket member having an upper portion connected to said first portion of said follower means, and a lower end mounting said pivot means, said means for magnifying comprising a plurality of vertically spaced-apart holes, said pivot means being mountable in any one of said holes by which mechanical advantage is altered.

18. In a lawn-sprinkler comprising a sprinkler-head and a stationary frame, said sprinkler-head comprising means forming a water-passageway through which water flows, nozzle-means in fluid communication with said water-passageway and through which the water discharges, mounting means for mounting said means forming a water passageway and said nozzle-means for rotation relative to said stationary frame, and a water-flap mounted by said mounting means for rotation therewith, said water-flap being operatively associated with said nozzle means for controlling the distance to which the water-discharge stream projects from said nozzle means, the improvement comprising:

means for variably adjusting said water-flap relative to said nozzle-means during one complete cycle of said mounting means in order to vary the position of said water-flap at least one time during said one complete cycle;

said stationary frame comprising a hollow mounting tube through which the water initially flows, and upstanding means having a lower end connected to said mounting tube, and an upper end, and a housing for mounting said means for variably adjusting, said upper end of said upstanding means supporting said housing, said housing being stationarily mounted thereby;

said upstanding means comprising a vertically-oriented post, said post passing through said mounting means for forming a water-passageway, through said nozzle means, and said means mounting said means forming a water-passageway, said upper end of said post projecting outwardly beyond a portion of said nozzle means for coupling with said housing.

* * * * *